United States Patent [19]

Collins

[11] 4,385,533

[45] May 31, 1983

[54] UNIVERSAL REACTION PLATE

[76] Inventor: Bobby W. Collins, P.O. Box 1366, Harvey, La. 70059

[21] Appl. No.: 297,143

[22] Filed: Aug. 28, 1981

[51] Int. Cl.[3] ..... B25B 13/46

[52] U.S. Cl. ..... 81/57.39

[58] Field of Search ..... 81/57.39

[56] References Cited

U.S. PATENT DOCUMENTS

| | | | |
|---|---|---|---|
| 3,745,858 | 7/1973 | Biach | 81/57.39 |
| 3,930,776 | 1/1976 | Keller | 81/57.39 |
| 4,027,560 | 6/1977 | Parker | 81/57.39 |
| 4,027,561 | 6/1977 | Junkers | 81/57.39 |
| 4,091,890 | 5/1978 | Wilmeth | 81/57.39 |
| 4,200,011 | 4/1980 | Wilmeth | 81/57.39 |
| 4,275,620 | 6/1981 | Collins | 81/57.39 |

*Primary Examiner*—James L. Jones, Jr.

*Attorney, Agent, or Firm*—Roy, Kiesel, Patterson & McKay

[57] ABSTRACT

A reaction plate assembly for use in a hydraulic torque wrench is disclosed comprising a reaction plate having a perimeter section provided with a series of spaced apart bolt openings and an adjacent perimeter section provided with at least one ring nut, bolt opening, a clevis pivotly mounted at one end by a bolt means at one of said series of bolt openings, the clevis having an opposite end pivotly mountable to a hydraulic cylinder, and a nut ring mounted at one end by a second bolt means to the adjacent perimeter section and provided with a nut opening having a cross-sectional shape to rotatably fit about a nut head.

20 Claims, 4 Drawing Figures

UNIVERSAL REACTION PLATE

BACKGROUND OF THE INVENTION

1. Field of the Invention

This invention relates generally to hydraulic torque wrenches, and more particularly to reaction plate assemblies for use on a hydraulic torque wrenches.

2. Prior Art

Because of the unique bolting configurations in industrial structures such as oil well heads, etc., an increasing need has developed for torque wrenches which have greater positioning flexibility, but which still have the ability to apply large torquing forces to bolt heads and nuts. This need has led to various hydraulic torquing wrenches such as those disclosed in the following patents:

| U.S. Pat. No. | ISSUED | INVENTOR | TITLE |
|---|---|---|---|
| U.S. 3,683,686 | 8/15/72 | Sergan | Mechanical Torque Wrench |
| U.S. 3,745,858 | 7/17/78 | Biach | Torquing Device |
| U.S. 3,930,776 | 1/06/76 | Keller | Hydraulic Wrench |
| U.S. 3,995,828 | 12/07/76 | Orban | Bolt Tensioning Apparatus |
| U.S. 4,027,561 | 6/07/77 | Junkers | Hydraulic Wrench |
| U.S. 4,060,137 | 11/29/77 | Bickford, et al | Torque Wrench |
| U.S. 4,091,890 | 5/30/78 | Wilmeth, et al | Very High Torque Ratchet Wrench |

However, these designs still do not have the desired positioning flexibility.

SUMMARY OF THE INVENTION

Therefore, one object of this invention is to provide a hydraulic torque wrench having positioning flexibility about various bolt configurations.

Another object of this invention is to provide a universal reaction plate assembly for use on a hydraulic torque wrench.

Other objects and advantages of this invention shall become apparent from the ensuing description of this invention.

Accordingly, a reaction plate assembly for use in a hydraulic torque wrench is provided comprising a reaction plate having a perimeter section provided with a series of spaced apart bolt openings and an adjacent perimeter section provided with at least one ring nut bolt opening; a clevis mounted at one end by attaching means to one of the series of bolt openings, the clevis provided with an attaching member for being pivotly mountable at its opposite end to one end of a hydraulic cylinder; and a nut ring mounted at one end by a nut ring attaching means to the adjacent perimeter section and provided with a nut opening positionable past the adjacent perimeter section and having a cross-sectional shape to matingly slip over a nut head.

PREFERRED EMBODIMENTS OF THE INVENTION

Figure 1:
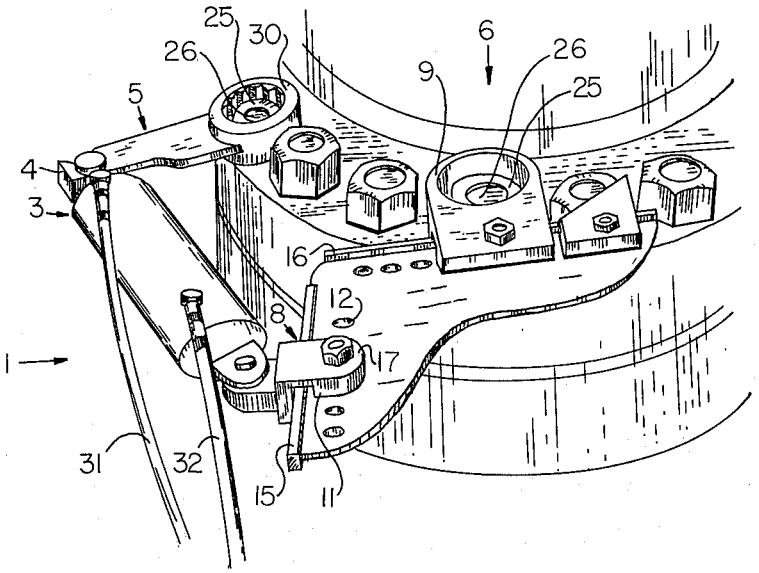
FIG. 1 is a three-dimensaional view of a preferred embodiment of the reaction plate assembly attached as part of a hydraulic torque wrench in operational position about a ring of well head flange bolts.

Turning now to FIG. 1, a hydraulic torque wrench, denoted generally by the number 1, is illustrated in operational position on a well head flange, denoted generally by the number 2. Wrench 1 comprises a hydraulic cylinder 3 having a wrench assembly receiving end 4 to which wrench assembly 5 is pivotly attachable, and a reaction plate assembly, denoted generally by the number 6.

Reaction plate assembly 6 in general comprises reaction plate 7, clevis 8, and nut ring 9. In a preferred embodiment, reaction plate assembly 6 also comprises angle reaction bar 10.

In a preferred embodiment reaction plate 7 comprises a perimeter section 11 provided with a series of spaced apart clevis bolt openings 12 and an adjacent perimeter section 13 provided with at least one ring nut bolt openings 14, but preferably a series of spaced apart such openings 14. Still more preferably, reaction plate 7 is constructed from a flat metal plate having sections 11 and 13 perpendicular with one another. In another preferred embodiment, each perimeter section 11 and 13 is provided with guide ridges 15 and 16, respectively, extending out along the edge of the respective perimeter sections as shown. In this embodiment, each series of bolt openings 12 and 14 are preferably drilled parallel to the respective guide ridges 15 and 16.

Figure 2:
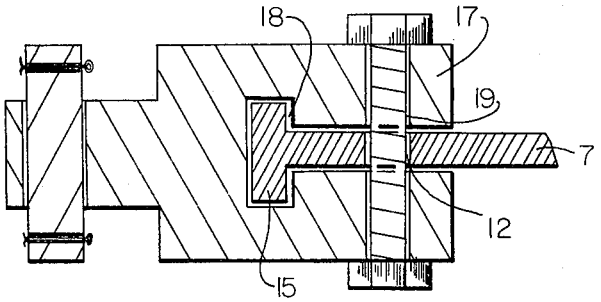
FIG. 2 is a cross-sectional view taken along lines 2—2 illustrating a preferred embodiment of the clevis.

Clevis 8 is provided with a means 17 for positioning and attaching the clevis to reaction plate 7. Turning now to FIG. 2, a preferred embodiment of means 17 is illustrated. In this embodiment, means 17 is constructed from a metal plate provided with a horizontal channel 18 shaped to slide over perimeter section guide ridge 15 and provided with bolt opening 19 positioned for alignment with one of plate bolt openings 12 so that bolt 20 can pass through both openings 12 and 19.

Figure 3:
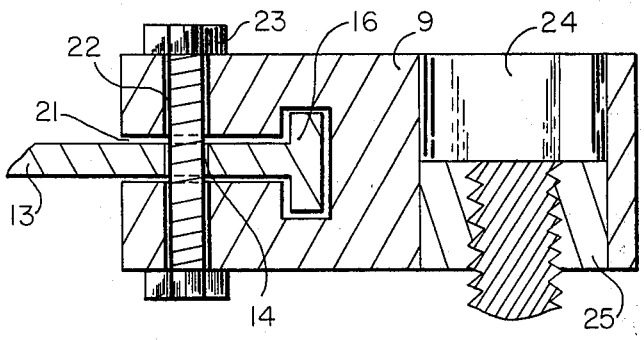
FIG. 3 is a cross-sectional view taken along lines 3—3 illustrating a preferred embodiment of this nut ring.

Nut ring 9, as shown in FIGS. 1 and 3, is constructed from a metal plate similarly provided with a horizontal channel 21 having a cross-sectional shape to slide over guide ridge 16 and provided with opening 22 positioned for alignment with one of plate bolt openings 14 so that bolt 23 can pass through both openings 14 and 22. Nut ring 9 is also provided with socket openings 24 having a cross-sectional shape to rotatingly fit about flange nut 25 threaded on flange bolt 26.

Figure 4:
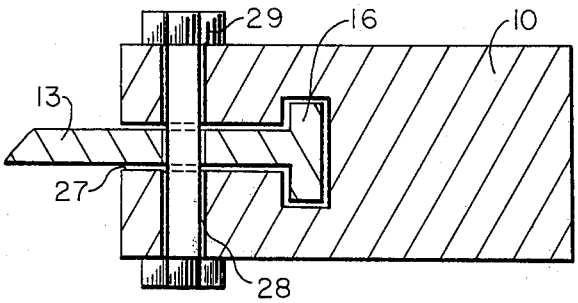
FIG. 4 is a cross-sectional view taken along lines 4—4 illustrating a preferred embodiment of the angle reaction bar.

Angle reaction bar 10 is preferably constructed by a triangular shaped metal plate such as seen in FIGS. 1 and 4 and is especially useful in a bonnet bolt arrangement where positioning of a conventional hydraulic torque wrench is extremely difficult or impossible. It is preferred that bar 10 also be provided with horizontal channel 27 having a cross-sectional shape to slide over guide ridge 16 and provided with opening 28 positioned for alignment with one of plate bolt openings 14 so that bolt 29 can pass through bolt openings 14 and 22.

In operation, wrench assembly 5 is positioned so that closed socket head 30 is placed about the flange nut 25 that is to be loosened or tightened. Then the clevis 8, nut ring 9 and angle reaction bar (if used) are positioned to obtain a positive force barrier against which the wrench assembly can push. This is accomplished by sliding clevis 8, nut ring 9 and angle reaction bar 10 along guide ridges 15 and 16, respectively, until nut ring socket opening 24 can fit about a second flange nut 25 when bolt 23 is passed through openings 14 and 22. When the proper position is found, then bolts 20 and 29 are also inserted through the proper openings and hydraulic pressure is applied in a conventional manner through hoses 31 and 32.

There are, of course, various alternate embodiments of this invention not specifically mentioned but which are intended to be included within the scope of this invention as defined in the following claims.

What I claim is:

1. A reaction plate assembly for use in a hydraulic torque wrench which comprises:

(a) a reaction plate having a perimeter section provided with a series of spaced apart bolt openings and an adjacent perimeter section provided with at least one ring nut bolt opening;

(b) a clevis mounted at one end by attaching means to one of said series of bolt openings, said clevis provided with an attaching member for being pivotly mountable at its opposite end to one end of a hydraulic cylinder; and (c) a nut ring mounted at one end by a nut ring attaching means to said adjacent perimeter section and provided with a nut opening positionable past said adjacent perimeter section and having a cross-sectional shape to matingly slip over a nut head.

2. A reaction plate assembly according to claim 1 wherein said adjacent perimeter section is provided with more than one space apart ring nut bolt opening.

3. A reaction plate assembly according to claim 1 wherein said reaction plate comprising a flat metal plate having said perimeter sections perpendicular to one another.

4. A reaction plate assembly according to claim 3 wherein each of said perimeter sections is provided with guide ridges extending out along the edge of said perimeter sections.

5. A reaction plate assembly according to claim 4 wherein said series of spaced apart bolt openings are parallel to said perimeter section guide ridge.

6. A reaction plate assembly according to claim 5 wherein said clevis attaching means comprises a second metal plate provided with a horizontal channel having a cross-sectional shape to slide over said perimeter section guide ridge and provided with an opening extending vertically through said second metal plate and positioned for alignment with one of said series of spaced apart bold openings.

7. A reaction plate assembly according to claim 4 wherein said nut ring attaching means comprises a third metal plate provided with a horizontal channel having a cross-sectional shape to slide over said adjacent perimeter section guide ridge and provided with an opening extending vertically through said third metal plate and positioned for alignment with said ring nut opening.

8. A reaction plate assembly according to claim 2 wherein said adjacent perimeter section comprises a flat metal plate provided with a guide ridge extending out along the edge of said adjacent perimeter section and wherein said ring nut bolt openings are parallel to said guide ridge.

9. A reaction plate assembly according to claim 8 wherein said nut ring attaching means comprises a third metal plate provided with a horizontal channel having a cross-sectional shape to slide over said adjacent perimeter section guide ridge and provided with an opening extending vertically through said third metal plate and positioned for alignment with said ring nut openings.

10. A reaction plate assembly according to claim 1 which comprises an angle reaction bar attached to said adjacent perimeter section.

11. A reaction plate assembly according to claim 10 wherein said edge reaction bar comprises a triangular, wedge-shaped metal member provided with an angle reaction bar attaching means for attaching said metal member to said adjacent perimeter section.

12. A reaction plate assembly according to claim 11 wherein said adjacent perimeter section is provided with a guide ridge extending out along the edge of said adjacent perimeter section and wherein said angle reaction bar attaching means is provided with a horizontal channel along one edge and between the triangular surfaces of said wedge, said channel having a cross-sectional shape to slide over said guide ridge and provided with an opening extending verticaly through said triangular surfaces and positioned for alignment with said ring nut bolt opening.

13. A hydraulic torque wrench comprising:

(a) a hydraulic cylinder;

(b) a wrench assembly comprising a metal shaft member having a socket means attached at one end of said shaft member, the other end of said shaft member being pivotly attached to one end of said hydraulic cylinder;

(c) a reaction plate assembly comprising:

(i) a reaction plate having a perimeter section provided with a series of spaced apart bolt openings and an adjacent perimeter section provided with at least one ring nut bolt opening;

(ii) a clevis mounted at one end by attaching means to one of said series of bolt openings, said clevis provided with an attaching member for being pivotly mountable at its opposite end to one end of a hydraulic cylinder provided with a clevis attaching member pivotly mounted at its opposite end to the opposite end of said hydraulic cylinder, and (iii) a nut ring mounted at one end by a nut ring attaching means to said adjacent perimeter section and provided with a nut opening positionable past said adjacent perimeter section and having a cross-sectional shape to rotatingly fit about a nut head.

14. A hydraulic torque wrench according to claim 13 wherein said reaction plate assembly comprises an angle reaction bar attached to said adjacent perimeter section.

15. A hydraulic torque wrench according to claim 14 wherein said angle reaction bar comprises a triangular, wedge-shaped metal member provided with an angle reaction bar attaching means for attaching said metal member to said adjacent perimeter section.

16. A hydraulic torque wrench according to claim 13 wherein said adjacent perimeter section is provided with more than one space apart ring nut bolt opening.

17. A hydraulic torque wrench according to claim 13 wherein;

(a) said reaction plate comprises a flat metal plate having said perimeter sections perpendicular to one another; and (b) each of said perimeter sections is provided with guide ridges extending out along the edge of said perimeter sections.

18. A hydraulic torque wrench according to claim 17 wherein:

(a) said series of spaced apart bolt openings are parallel to said perimeter section guide ridge; and (b) said clevis attaching means comprises a second metal plate provided with a horizontal channel having a cross-sectional shape to slide over said perimeter section guide ridge and provided with an opening extending vertically through said second metal plate and positioned for alignment with one of said series of spaced apart bolt openings.

19. A hydraulic torque wrench according to claim 17 wherein said nut ring attaching means comprises a third metal plate provided with a horizontal channel having a cross-sectional shape to slide over said adjacent perimeter section guide ridge and provided with an opening extending vertically through said third metal plate and positioned for alignment with said ring nut opening.

20. A hydraulic torque wrench according to claim 16 wherein:

(a) said adjacent perimeter section comprises a flat metal plate provided with a guide ridge extending out along the edge of said adjacent perimeter section and wherein said ring nut bolt openings are parallel to said guide ridge, (b) said nut ring attaching means comprises a third metal plate provided with a horizontal channel having a cross-sectional shape to slide over said adjacent perimeter section guide ridge and provided with an opening extending vertically through said third metal plate and positioned for alignment with said ring nut opening.

* * * * *